United States Patent [19]

Persi

[11] Patent Number: 4,752,147

[45] Date of Patent: Jun. 21, 1988

[54] FLUID APPLICATOR SYSTEM

[76] Inventor: John Persi, 5616 E. Aster Dr., Scottsdale, Ariz. 85254

[21] Appl. No.: 947,104

[22] Filed: Dec. 29, 1986

[51] Int. Cl.[4] ..... B05C 17/00; A45D 34/00; A47L 13/16; A46B 11/00

[52] U.S. Cl. ..... 401/126; 401/123; 401/127; 401/130

[58] Field of Search ..... 401/123, 124, 125, 126, 401/130, 121, 119, 118, 127; 15/257.05

[56] References Cited

U.S. PATENT DOCUMENTS

| | | | |
|---|---|---|---|
| 557,014 | 3/1896 | Osgood | 401/127 |
| 1,063,484 | 6/1913 | Weismantel . | |
| 1,450,386 | 4/1923 | Regan | 401/130 |
| 1,534,259 | 4/1925 | Dempsey | 401/130 |
| 1,643,815 | 9/1927 | Lesquendieu . | |
| 1,943,647 | 1/1934 | Weller | 401/126 X |
| 1,975,016 | 9/1934 | Nassif | 401/119 |
| 2,017,852 | 10/1935 | Chisholm . | |
| 2,242,947 | 5/1941 | Griffis | 401/130 |
| 2,568,814 | 9/1951 | Marcellus . | |
| 2,613,011 | 10/1952 | Foreshaw-Smith . | |
| 2,790,984 | 5/1957 | Gilpin | 401/125 |
| 3,221,359 | 12/1965 | Moroni et al. . | |

FOREIGN PATENT DOCUMENTS

| | | | |
|---|---|---|---|
| 1945762 | 3/1971 | Fed. Rep. of Germany | 401/118 |
| 12228 | 5/1896 | Switzerland | 401/130 |

*Primary Examiner*—Steven A. Bratlie

*Attorney, Agent, or Firm*—Gifford, Groh, VanOphem, Sheridan, Sprinkle and Dolgorukov

[57] ABSTRACT

A fluid applicator system includes a fluid containing jar, an applicator sponge attached to a lid, and a perforated plate for maintaining the sponge in a compressed state against the closed lid to regulate the amount of fluid which it can absorb. The sponge is compressed by inserting it into the jar so that it abuts the perforated plate while the lid simultaneously seals the jar. The extent of compression of the sponge, and thereby the amount of fluid which it can absorb, is regulated by adjusting the level of the perforated plate within the jar prior to exposing the fluid to the sponge.

9 Claims, 1 Drawing Sheet

FLUID APPLICATOR SYSTEM

BACKGROUND OF THE INVENTION

I. Field of the Invention

This invention relates to fluid applicator systems and, in particular, to a jar having a lid with an applicator pad and being capable of regulating the amount of fluid absorbed by the applicator pad.

II. Description of the Prior Art

Previously known fluid applicator systems have included applicator sponges or pads adhered to lids or covers of fluid containing jars. Such a fluid applicator system is disclosed in U.S. Pat. No. 3,221,359 to R. Moroni et al. However, previously known applicator systems, including that disclosed by Moroni, have a major drawback in that the amount of fluid taken up by the sponge or pad cannot be accurately regulated. This is because as the lid and pad are withdrawn from the jar, the sponge expands to its relaxed state while still contacting the fluid, and thereby becomes saturated with the fluid.

Another type of fluid applicator system is disclosed to U.S. Pat. No. 2,613,011 to R. Foreshaw-Smith. The Foreshaw-Smith applicator system comprises a shallow dish or jar with a lid. A perforated false bottom plate is disposed in the jar leaving spaces both above and below it. The space below contains a fluid while the space above houses layered applicator pads. By shaking and by capillary action the pads in the upper space are saturated by fluid from the lower space which passes through the perforations. Again, however, there is no means for regulating the amount of fluid absorbed by the pads and they will become fully saturated with the fluid.

SUMMARY OF THE PRESENT INVENTION

These and other disadvantages are overcome by the present invention which provides a fluid containing jar and a lid having an applicator sponge disposed on its underside. A perforated plate is arranged in the interior of the jar near its top so as to compress the applicator sponge to a predetermined compressed state when the lid is placed in position on the jar.

The jar may be of any dimension or shape provided that it has a cylindrical neck portion into which the perforated plate may be secured. Preferably, the plate is adjustable and may be disposed at varying depths in the neck of the jar. The jar may be made of any convenient rigid material such as glass, metal or plastic.

The lid is dimensioned to sealingly engage the top neck portion of the jar, and preferably includes a handle on the upper lid surface. The lid may be provided with a hexagonal portion or a knurled portion to facilitate grasping and removal of the lid. The applicator sponge is adhered to the lower surface of the lid and extends into the jar to abut the perforated plate when the lid is attached to the jar. Thus, by abutting the perforated plate the sponge is stored in a compressed state which limits the amount of fluid that it can absorb and retain prior to removal. By adjusting the perforated plate further into the neck of the jar, the sponge will be stored in a less compressed state and thus may absorb a greater amount of fluid until it becomes saturated. Conversely, by raising the perforated plate, the sponge is stored in a more compressed state which further limits the amount of fluid which it can absorb.

Thus, the present invention is advantageous in that the applicator sponge may be withdrawn and used without being saturated and, furthermore, the extent to which the sponge remains unsaturated is variable by adjusting the level of the perforated plate. In addition, the device of the present invention allows the user to apply a lotion or other fluid to large areas without pouring the fluid onto his or her hands. Such application is less wasteful and less messy than previously known applicator systems.

BRIEF DESCRIPTION OF THE DRAWING

The present invention will be more fully understood by reference to the following detailed description, when read in conjunction with the accompanying drawing in which like reference characters refer to like parts throughout the several views, and in which.

DETAILED DESCRIPTION OF THE PREFERRED EMBODIMENT

Figure 1:
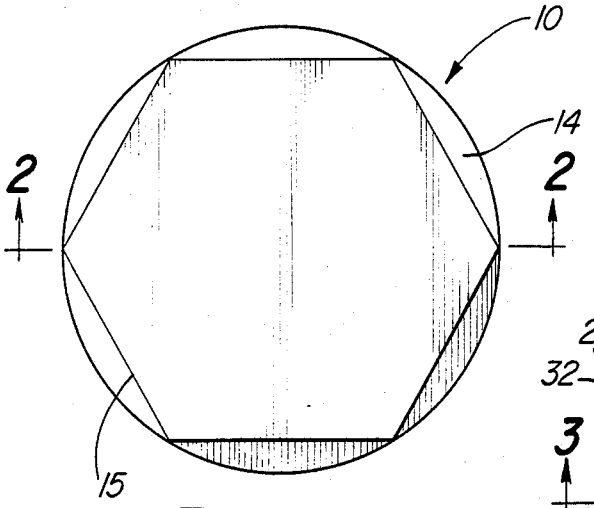
FIG. 1 is a top plan view of one embodiment of the fluid applicator system of the present invention.
Figure 2:
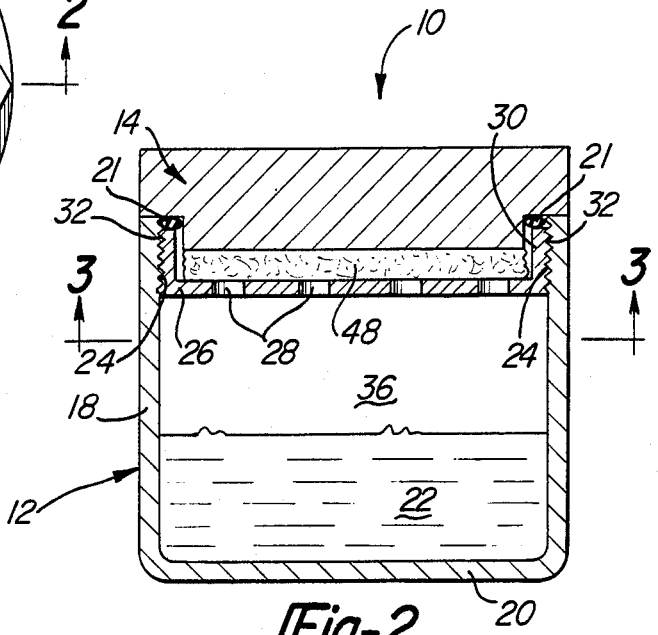
FIG. 2 is a cross sectional view taken substantially along line 2—2 of FIG. 1.

Referring first to FIGS. 1 and 2, a fluid applicator system 10 embodying the present invention is thereshown comprising a jar 12 and a lid 14. As best shown in FIG. 2, the jar 12 comprises an annular wall 18 having a lip defining an opening at its top and a bottom 20. The lid 14 is insertable into the open top of the jar 12 to sealingly engage the lip portion of the annular wall 18. Sealing means 21, such as threads or an O-ring, prevent the fluid 22 from leaking from the jar 12 when it is upset or overturned. A hexagonal portion 15 is provided on the lid 14 to facilitate grasping and rotating the lid 14 for removal and replacement. In the preferred embodiment, an upper portion of the inner periphery of annular wall 18 contains screw threads 24 for a purpose to be described in detail hereinafter.

Figure 3:
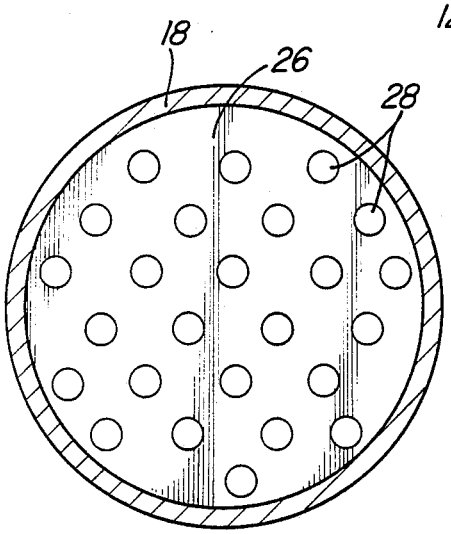
FIG. 3 is a cross sectional view taken substantially along line 3—3 of FIG. 2.
Figure 4:
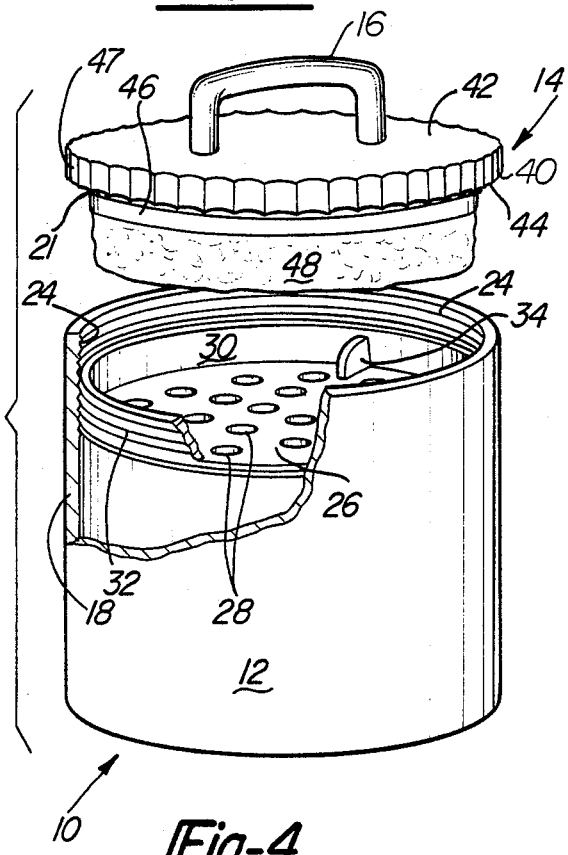
FIG. 4 is an exploded perspective view of another embodiment of the fluid applicator system of the present invention with portions removed for clarity.

Referring now to FIGS. 2–4, a circular plate 26 is disposed in the upper portion of the jar 12 and extends from one side of the annular wall 18 to the other. The plate 26 contains numerous perforations 28 for a purpose to be described subsequently. In the preferred embodiment, the plate 26 comprises an annular flange 30 which may extend either upwardly or downwardly from the outer periphery of the plate 26. The outer periphery of the annular flange 30 contains screw threads 32 which correspondingly engage the screw threads 24 on the inner periphery of annular wall 18. Thus, the plate 26 may conveniently be rotated within the jar 12 and, by means of the corresponding screw threads 32, 24, the plate 26 may be lowered or raised with respect to the top of the jar 12. Tabs 34 (FIG. 4) may conveniently be attached to the plate 26 to facilitate said rotation. The plate 26 defines a space 36 which is below the plate 26 but above the level of the fluid 22 in the jar 12.

It can easily be understood that, for a given type of fluid 22, it would be possible for a manufacture to fix the plate 26 at a predetermined level. This would permit a fixed compression state, say for example 50% of the sponge 48, hereinafter described. It is also possible to provide locking means to prevent inadvertent rotation of the plate 26 and thereby to lock the plate 26 at a particular level.

Referring particularly to FIG. 4, the lid 14 is thereshown in an alternate embodiment comprising a substantially circular disk 40 having an upper surface 42 and a lower surface 44. A loop-like handle 16 is provided on the upper surface 42. The handle 16 may be grasped for removal of the lid 14. In addition, the user may slide one or more fingers under the loop to secure the lid 14 to his or her hand during the application of fluid. The sealing means 21 may conveniently be provided on the lower surface 44 or on a reduced diameter extension 46 protruding from the lower surface 44. The edge 47 of the lid 14 is conveniently knurled to facilitate grasping in this embodiment.

A compressible pad or sponge 48 is secured to the lower surface 44 of the lid 14. Conveniently, the sponge 48 is circular in shape and dimensioned to just fit within the annular wall 18 of the jar 12 or, alternatively, within the annular flange 30 of the plate 26. The pad or sponge 48 may be of any suitable material provided it is capable of compression by the plate 26 and is capable of absorbing an amount of the fluid 22 in inverse proportion to its compression state. For example, the sponge 48 in its relaxed state, as shown in FIG. 4, could absorb a great amount of fluid 12 and thereby become saturated. On the other hand, the sponge 48 shown in FIG. 2 in a compressed state, can absorb a proportionately smaller amount of fluid 22 due to its compression against the plate 26. Thus, the amount of fluid absorbed by the sponge 48 is regulated by the extent of compression of the sponge 48 when the jar 12 is closed, which in turn affects the saturatability of the sponge 48.

If it is desired that the sponge 48 absorb a greater amount of fluid 22, the user can simply rotate the plate 26 to a lower position within the jar 12 using the tabs 34. This will permit the sponge 48 to be stored in a less compressed state and, thereby will cause it to absorb a greater amount of fluid 22. Conversely, if the sponge 48 is absorbing too much of the fluid 22 for a given application, the plate 26 may be rotated to a higher position within the jar 12. This causes a greater compression of the sponge 48 in the stored state, and a corresponding reduction in the amount of fluid 22 which the sponge 48 can absorb.

The fluid 22 may comprise any fluid which is to be applied to a surface. Specifically, the fluid applicator system of the present invention is well adapted for the application of suntan lotions, moisturizers and other cosmetic lotions to the skin of an individual. The user simply compresses the sponge 48 against the plate 26 by sealing the lid 14 on the top of the jar 12. By shaking or overturning the jar, the fluid 22 passes across the space 36 and through the perforations 28 to be absorbed by the sponge 48. Turning the jar upright once again and removing the lid 14 ensures that a regulated amount of the fluid 22 remains absorbed by the sponge 48. If a greater or lesser amount of the fluid 22 is required, the amount of absorbtion can be adjusted by altering the position of the plate 26 as previously described.

It can be seen that the applicator of the present invention provides a tidy and economical way to apply fluids. Fluids are not wasted by pouring excessive amounts onto hands prior to application. In addition, the area of the sponge allows the user to apply fluids quickly and efficiently to large areas, without constantly repouring the fluid from the container.

The foregoing detailed description of the preferred embodiment has been given for clearness of understanding and no unnecessary limitations should be understood therefrom. Some modifications will be obvious to those skilled in the art to which the invention pertains, without deviation from the spirit of the invention as defined by the scope of the appended claims.

I claim:

1. A fluid applicator system comprising a fluid containing jar comprising an annular wall and a bottom, said annular wall having a lip defining an opening at its top;

a lid dimensioned to removably sealingly engage said lip to close said opening;

a resilient sponge secured to an underside of said lid;

means for compressing said sponge against said lid when said lid engages said lip; and means for adjusting said compression means to vary the extent of compression of said sponge when said lid engages said lip, whereby the amount of fluid that can be absorbed by said sponge is regulated by varying the extent of compression of said sponge prior to removing it from said jar, comprising screw threads disposed on the inside of said annular wall and corresponding screw threads disposed on said compression means in threaded engagement with the first mentioned screw threads, whereby said compressing means is supported within said jar and whereby rotating of said compressing means relative said wall so as to move said compressing means inwardly of said jar lessens the extent of compression of said sponge, and rotating said compressing means relative said wall in a direction to move said compressing means outwardly of said jar increases the extent of compression of said sponge.

2. The applicator system defined in claim 1 wherein said compressing means comprises a perforated circular plate extending across said annular wall at a location spaced apart from said fluid when said jar is upright.

3. The applicator system defined in claim 1 wherein said lid comprises a loop-like handle disposed on an upper side of said lid.

4. The applicator system defined in claim 1 wherein said compressing means comprises a perforated plate having an annular flange extending from the outer periphery of said plate, and wherein said corresponding screw threads are disposed on an outer periphery of said annular flange.

5. The applicator system defined in claim 1 and comprising an O-ring seal between said lid and said lip to seal said jar when said lid engages said lip.

6. The applicator system defined in claim 1 and comprising tabs disposed on said compressing means to facilitate rotation thereof.

7. The applicator system defined in claim 1 wherein said means for adjusting said compressing means is preset to compress said sponge approximately 50% when said lid engages said lip.

8. The applicator system defined in claim 1 wherein said lid comprises a hexagonal portion.

9. The applicator system defined in claim 1 wherein said lid comprises a knurled edge.

* * * * *